US007703310B2

(12) United States Patent
Usuzaki et al.

(10) Patent No.: US 7,703,310 B2
(45) Date of Patent: Apr. 27, 2010

(54) DOOR OPENING AND CLOSING DEVICE FOR VEHICLE AND ASSEMBLY METHOD THEREOF

(75) Inventors: Yuuichi Usuzaki, Miyazaki (JP); Fumio Kobayashi, Miyazaki (JP); Naoki Katsumata, Saitama (JP); Nobuyuki Kishikawa, Saitama (JP); Hidetoshi Ijuin, Saitama (JP)

(73) Assignees: Kabushiki Kaisha Honda Lock, Miyazaki (JP); Honda Motor Co., Ltd., Tokyo (JP)

( * ) Notice: Subject to any disclaimer, the term of this patent is extended or adjusted under 35 U.S.C. 154(b) by 727 days.

(21) Appl. No.: 10/535,995

(22) PCT Filed: Nov. 14, 2003

(86) PCT No.: PCT/JP03/14542

§ 371 (c)(1),
(2), (4) Date: Feb. 17, 2006

(87) PCT Pub. No.: WO2004/055304

PCT Pub. Date: Jul. 1, 2004

(65) Prior Publication Data

US 2006/0214467 A1 Sep. 28, 2006

(30) Foreign Application Priority Data

Dec. 17, 2002 (JP) ..... 2002-365795

(51) Int. Cl.
*E05B 47/00* (2006.01)

(52) U.S. Cl. ..... 70/237; 70/256; 292/125; 292/199; 292/201; 292/225

(58) Field of Classification Search ..... 70/237, 70/256, 257, 190, 191, 239; 292/160, 171, 292/172, 141, 142, 28, 39, 112, 225, 235, 292/199, 125, 51, 50, 133, 144, 201
See application file for complete search history.

(56) References Cited

U.S. PATENT DOCUMENTS 1,368,526 A * 2/1921 Patterson ..... 70/306

(Continued)

FOREIGN PATENT DOCUMENTS

EP 0 692 595 A1 1/1996

(Continued)

*Primary Examiner*—Lloyd A Gall
(74) *Attorney, Agent, or Firm*—Carrier, Blackman & Associates, P.C.; Joseph P. Carrier; William D. Blackman

(57) ABSTRACT

In a door opening and closing device for a vehicle in which a cylinder body of a cylinder lock having a rotor turned in response to a key operation and a casing of a door-locking device which has a door-locking lever shaft turned in response to the turning of the rotor and is switched over between a locking state and an unlocking state in response to the turning of the door-locking lever shaft are mounted to a door, a turning movement-transmitting member having a flexibility is disposed between the cylinder lock and the door-locking device so as to transmit a turning force of the rotor to the door-locking lever shaft by its twisting motion responsive to the turning of the rotor. Thus, it is possible to increase the degree of freedom for the relative dispositions of the cylinder lock and the door-locking device, while eliminating the need for a protector for preventing the unauthorized access from the outside.

9 Claims, 8 Drawing Sheets

U.S. PATENT DOCUMENTS

| | | | | | |
|---|---|---|---|---|---|
| 1,724,424 | A | * | 8/1929 | Sandholdt, Jr. | 70/262 |
| 1,857,654 | A | * | 5/1932 | Mylar | 70/165 |
| 1,880,135 | A | * | 9/1932 | Heath | 292/127 |
| 1,918,093 | A | * | 7/1933 | Gang | 70/255 |
| 2,427,436 | A | * | 9/1947 | Beems et al. | 292/164 |
| 4,609,233 | A | * | 9/1986 | Walla | 312/219 |
| 4,974,886 | A | * | 12/1990 | Kleefeldt et al. | 292/201 |
| 5,233,849 | A | * | 8/1993 | Forbers | 70/256 |
| 5,537,848 | A | * | 7/1996 | Grzanka et al. | 70/279.1 |
| 5,647,234 | A | * | 7/1997 | Foster | 70/256 |
| 5,715,713 | A | * | 2/1998 | Aubry et al. | 70/277 |
| 5,894,749 | A | * | 4/1999 | Tomaszewski et al. | 70/240 |
| 5,996,382 | A | * | 12/1999 | Lehmkuhl | 70/256 |
| 6,655,179 | B2 | * | 12/2003 | Kobayashi et al. | 70/237 |
| 6,938,446 | B2 | * | 9/2005 | Fukunaga et al. | 70/237 |
| 7,213,428 | B2 | * | 5/2007 | Harada et al. | 70/256 |
| 2002/0184931 | A1 | * | 12/2002 | Wittwer | 70/237 |
| 2005/0258652 | A1 | * | 11/2005 | Usuzaki et al. | 292/216 |

FOREIGN PATENT DOCUMENTS

| | | |
|---|---|---|
| EP | 1 079 048 A1 | 2/2001 |
| JP | 61-19789 | 5/1986 |
| JP | 07-097881 | 4/1995 |
| JP | 07-269203 | 10/1995 |

* cited by examiner

DOOR OPENING AND CLOSING DEVICE FOR VEHICLE AND ASSEMBLY METHOD THEREOF

FIELD OF THE INVENTION

The present invention relates to a door opening and closing device for a vehicle and an assembly method thereof in which a cylinder body of a cylinder lock having a rotor turned in response to a key operation and a casing of a door-locking device which has a door-locking lever shaft turned in response to the turning of the rotor and is switched over between a locking state and an unlocking state in response to the turning of the door-locking lever shaft are mounted to a door.

BACKGROUND ART

There is a door opening and closing device for a vehicle already known, which is designed so that a power upon turning of a rotor of a cylinder lock in response to a key operation is converted into the axial movement of a rod and transmitted to a door-locking device (for example, see Patent Document 1).

In a structure in which a cylinder lock and a door-locking device are connected to each other by a rod, as described above, however, there is a possibility that the door-locking device might be brought into an unlocking state as undesired by directly operating the rod axially by an unauthorized access from the outside. To prevent the unlocking due to the unauthorized access from the outside, it is necessary to cover the rod with a protector.

A door opening and closing device for a vehicle is already realized, which is designed so that a joint extending rearwards from a cylinder lock is coaxially connected to a door-locking lever shaft of a door-locking device in order to eliminate the need for such a protector, for example, as disclosed in Patent Document 2, whereby the unauthorized access from the outside is impossible, while eliminating the need for the protector (Patent Document 1)

Japanese Patent Application Laid-open No. 7-97881

(Patent Document 2)

Japanese Patent Publication No. 61-19789

In the arrangement in which the joint extending rearwards from the cylinder lock is coaxially connected to the door-locking lever shaft of the door-locking device, however, the protector is not required, but the center of turning of the cylinder lock and the axis of the door-locking lever shaft in the door-locking device must be disposed on the same axis, resulting in a reduction in degree of freedom for the relative dispositions of the cylinder lock and the door-locking device.

DISCLOSURE OF THE INVENTION

The present invention has been accomplished with such circumstances in view, and it is an object of the present invention to provide a door opening and closing device for a vehicle and an assembly method thereof, wherein the degree of freedom for the relative dispositions of the cylinder lock and the door-locking device is increased, while eliminating the need for the protector for preventing the unauthorized access from the outside.

To achieve the above object, according to a first aspect and feature of the present invention, there is provided a door opening and closing device for a vehicle in which a cylinder body of a cylinder lock having a rotor turned in response to a key operation and a casing of a door-locking device which has a door-locking lever shaft turned in response to the turning of the rotor and is switched over between a locking state and an unlocking state in response to the turning of the door-locking lever shaft are mounted to a door, characterized in that a power-transmitting mechanism is accommodated in a case detachably connected to the cylinder body mounted to the door, the power-transmitting mechanism including a transmitting wheel relatively non-turnably connected to the rotor in response to the mounting of the case to the cylinder body, and a turning movement-transmitting member having a flexibility is connected at one end thereof to the power-transmitting mechanism so as to perform twisting motion responsive to the turning of the transmitting wheel, and the turning movement-transmitting member is operatively connected at the other end thereof to the door-locking lever shaft in such a manner that the door-locking device and the turning movement-transmitting member are constructed in the form of a unit.

With the above arrangement, the turning of the rotor in the cylinder lock is transmitted to the door-locking lever shaft of the door-locking device by the twisting motion of the turning movement-transmitting member. Therefore, it is unnecessary to dispose a turning axis of the rotor and an axis of the door-locking lever shaft on the same axis, whereby the degree of freedom for the relative dispositions of the cylinder lock and the door-locking device can be increased. Moreover, it is difficult to twist the turning movement-transmitting member having the flexibility by the unauthorized access from the outside, and a protector for covering the turning movement-transmitting member is not required, which can contribute to a reduction in number of parts.

Additionally, the rotor of the cylinder lock and the one end of the turning movement-transmitting member are operatively connected to each other by mounting the door-locking device constructed in the form of the unit along with turning movement-transmitting member to the door and then mounting the case to the cylinder body of the cylinder lock mounted to the door. Thus, it is easy to connect the cylinder lock and the door-locking device by the turning movement-transmitting member.

According to a second aspect and feature of the present invention, in addition to the first feature, the turning movement-transmitting member is operatively connected at one end thereof to the rotor so as to extend in the direction perpendicular to the axis of the rotor. With such arrangement, an area where the one end of the turning movement-transmitting member is connected to the rotor of the cylinder lock cannot occupy a large space at the rear of the cylinder lock and hence, it is unnecessary to take into consideration the interference with a glass or the like accommodated in the door.

According to a third aspect and feature of the present invention, in addition to the second feature, the power-transmitting mechanism comprising a first bevel gear as the transmitting wheel and a second bevel gear meshed with the first bevel gear is turnably carried between first and second case halves forming the case and connected to each other, and the turning movement-transmitting member is connected at one end thereof to the second bevel gear. With such arrangement, the construction of the power-transmitting mechanism can be simplified, and the loss of transmission of the turning force by the twisting of the turning movement-transmitting member can be absorbed by adjusting the number of teeth of the first and second bevel gears to increase the transmission ratio.

According to a fourth aspect and feature of the present invention, in addition to any of the above features, the turning movement-transmitting member and the door-locking device are connected to each other through a universal joint.

According to a fifth aspect and feature of the present invention, there is provided an assembly method of a door opening and closing device for a vehicle in which, in assembling the door opening and closing device for the vehicle according to the first aspect and feature, the turning movement-transmitting member is connected at the other end thereof to the door-locking lever shaft and the door-locking device constructed in the form of the unit along with the turning movement-transmitting member is mounted to the door and then the case is mounted to the cylinder body of the cylinder lock mounted to the door.

BRIEF DESCRIPTION OF THE DRAWINGS

FIG. 1 is a perspective view showing a door-locking device and a cylinder lock in their connected states;

FIG. 2 is a view of the door-locking device and the cylinder lock in unlocking states with a lid plate omitted, taken in the direction indicated by an arrow 2 in FIG. 1;

FIG. 3 is an enlarged sectional view taken along a line 3-3 in FIG. 2;

FIG. 4 is an enlarged sectional view taken along a line 4-4 in FIG. 2;

FIG. 5 is an enlarged view of essential portions of FIG. 2 in a state in which the door-locking device is in the unlocking state, but the rotor of the cylinder lock has been returned to a neutral position;

FIG. 6 is an enlarged view of essential portions of FIG. 2 when the door-locking device has been brought into a locking state;

FIG. 7 is an exploded perspective view of a universal joint;

FIG. 8 is a perspective view showing a state in which an inner cable has been connected to the universal joint; and FIG. 9 is a perspective view of a retaining case.

BEST MODE FOR CARRYING OUT THE INVENTION

The mode for carrying out the present invention will now be described by way of an embodiment with reference to the accompanying drawings.

FIGS. 1 to 9 show an embodiment of the present invention.

Figure 1:
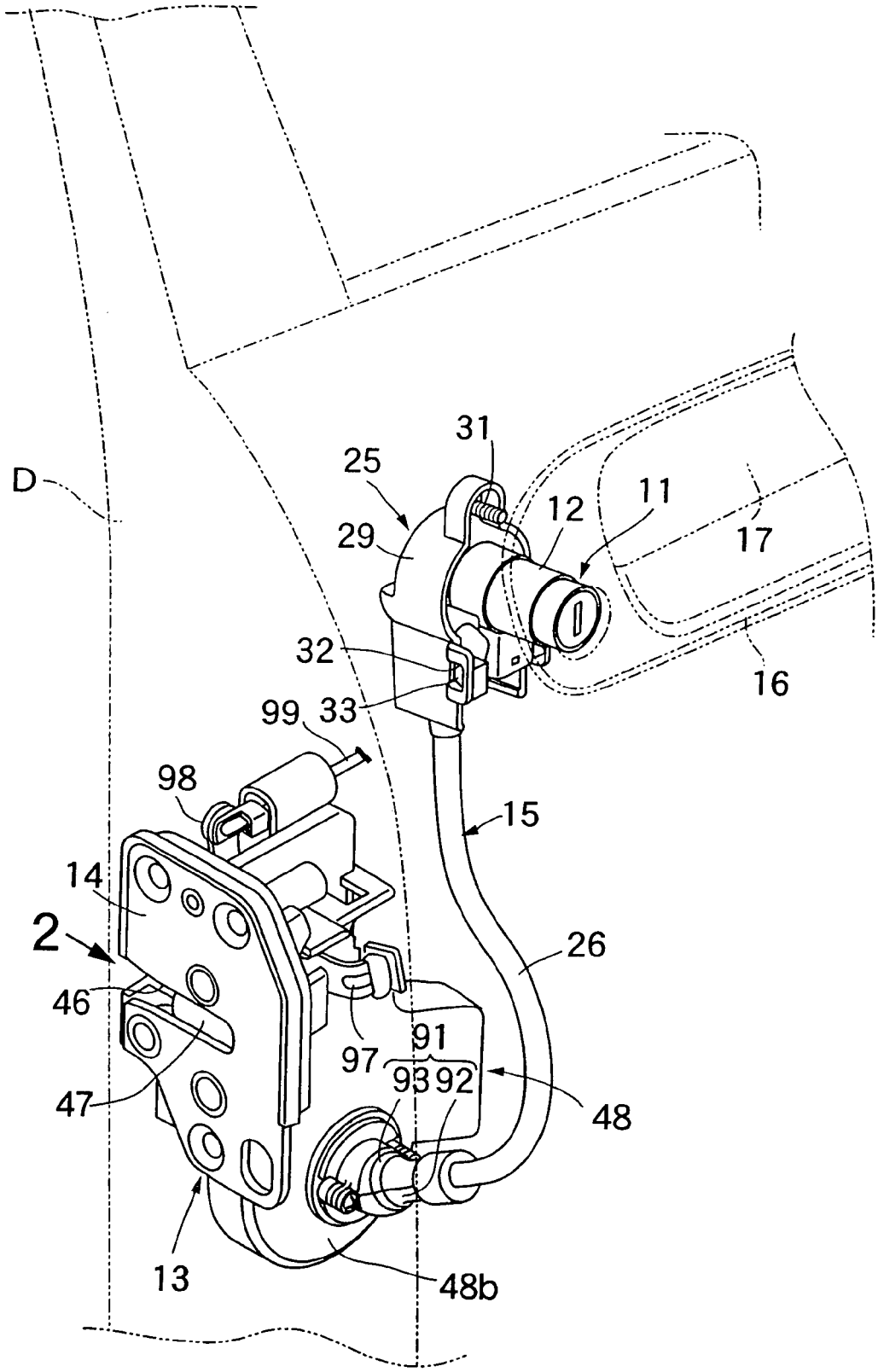
FIGS. 1 to 9 show an embodiment of the present invention.
Figure 2:
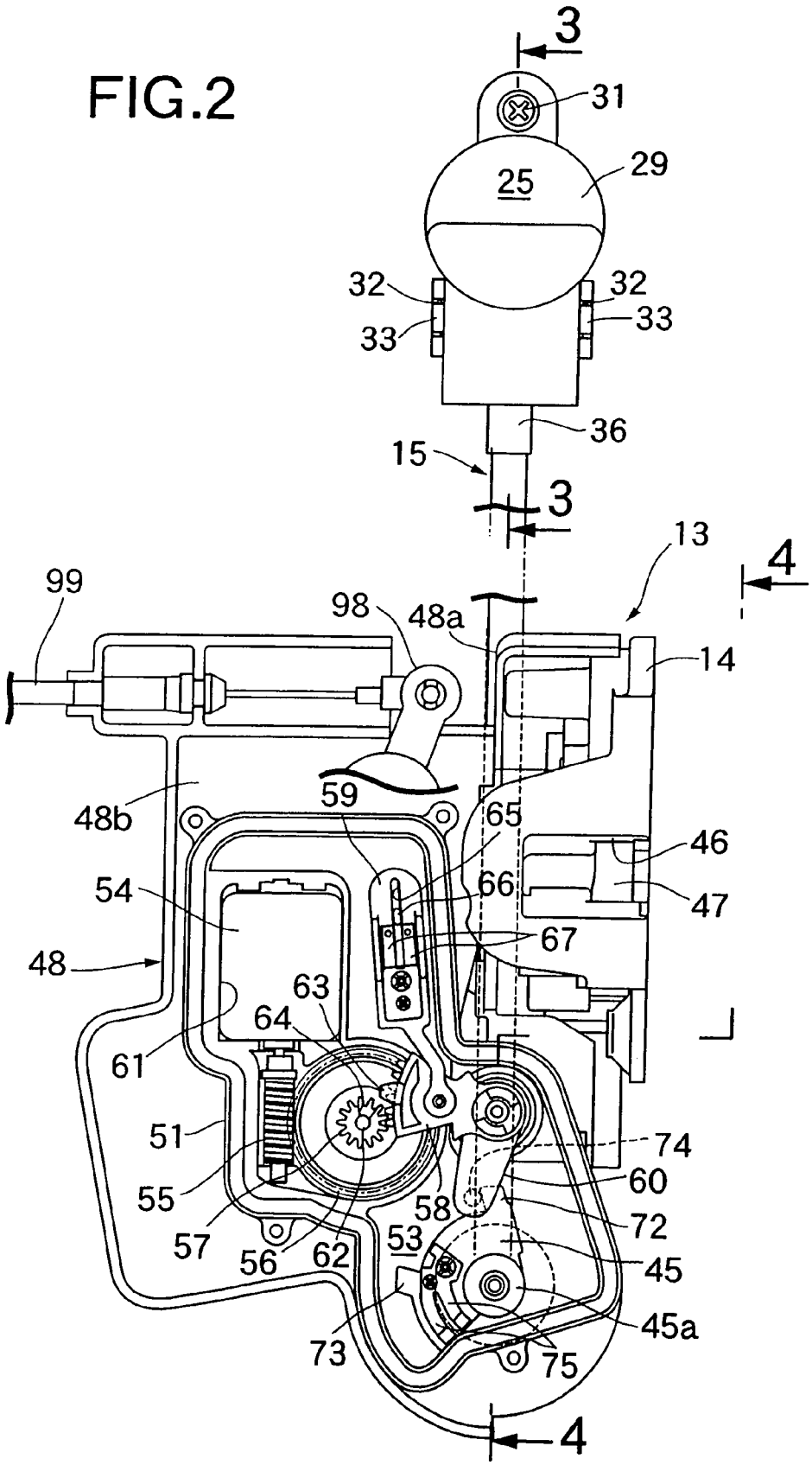

Referring first to FIGS. 1 and 2, a cylinder body 12 of a cylinder lock 11 and a casing 14 of a door-locking device 13 for switching over between a door-locking state and a door-unlocking state in response to the key operation of the cylinder lock 11 are mounted to, for example, a right door D in an automobile vehicle, so that a turning force generated with the key operation of the cylinder lock 11 is transmitted to the door-locking device 13 through a turning movement-transmitting member 15 having a flexibility.

Figure 3:
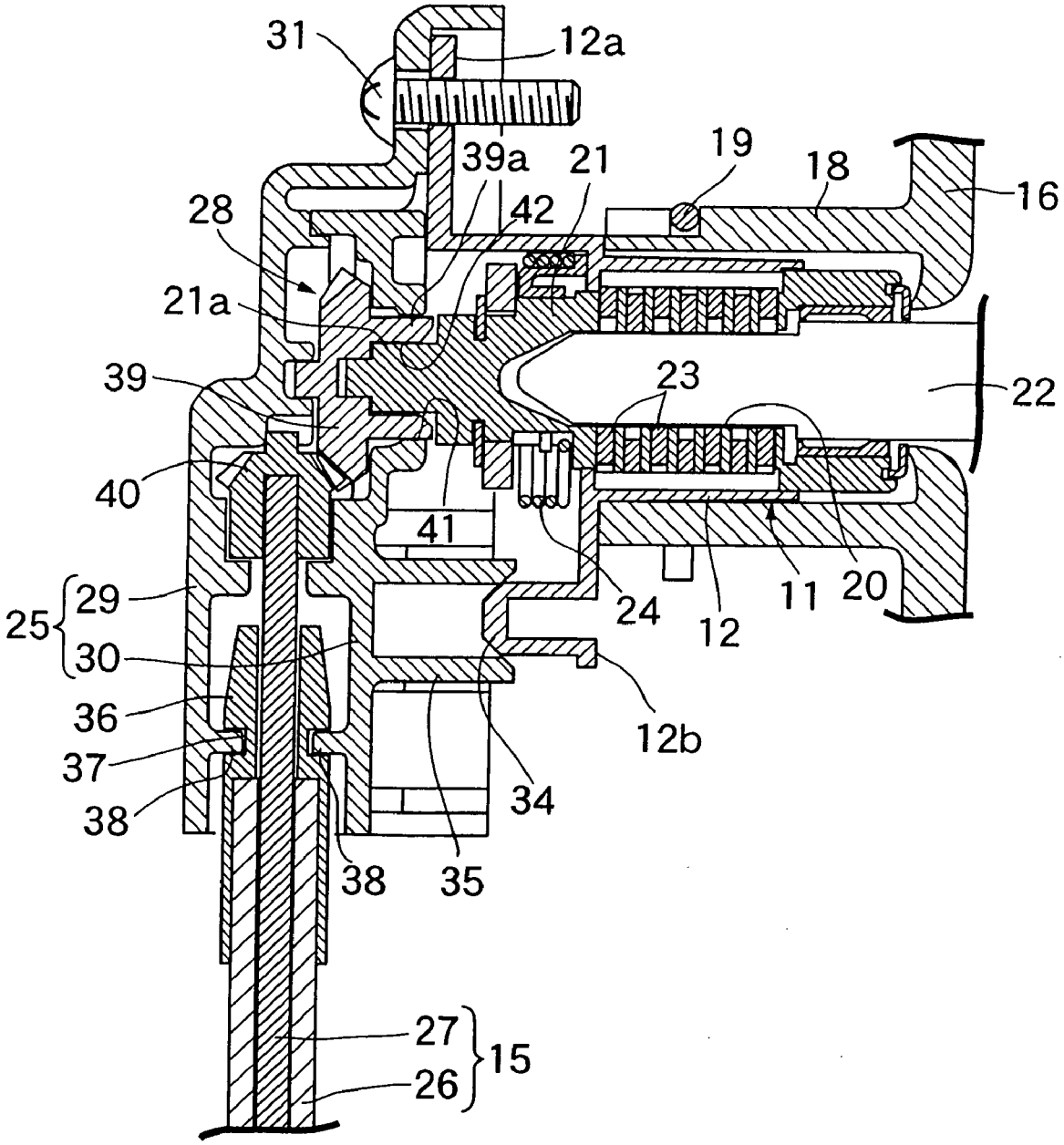

Referring to FIG. 3, a handle case 16 is mounted to an outer side of the door D, and an outside handle 17 is vertically turnably mounted to the handle case 16. The cylinder body 12 of the cylinder lock 11 is inserted from the inside into a support tube 18 integrally provided on the handle case 16 to extend inwards of the door D, and a retaining ring 19 engaged with both of the support tube 18 and the cylinder body 12 is mounted to the support tube 18, whereby the cylinder body 12 is mounted to the door D.

A rotor 21 having a key hole 20 is turnably inserted into the cylinder body 12, and a plurality of tumblers 23 disengaged from the cylinder body 12 by inserting a normal key 22 into the key hole 20 are disposed at a plurality of points spaced apart from one another in an axial direction of the rotor 21. A return spring 24 for returning the rotor 21 to a neutral position is mounted between the rotor 21 and the cylinder body 12.

When the normal key 22 is inserted into the key hole 20 to turn the rotor 21, for example, through 70 degree rightwards from the neutral position, the door-locking device 13 in the unlocking state is switched over to the locking state. When an operating force applied to the key 22 is released, the rotor 21 is returned to the neutral position. When the normal key 22 is inserted into the key hole 20 to turn the rotor 21, for example, through 70 degree leftwards from the neutral position, the door-locking device 13 in the locking state is switched over to the unlocking state. When the operating force applied to the key 22 is released, the rotor 21 is returned to the neutral position.

A connecting shaft portion 21*a* is provided coaxially and integrally at a rear end of the rotor 21, and one end of the turning movement-transmitting member 15 is operatively connected to the connecting shaft portion 21*a*.

The turning movement-transmitting member 15 comprises an inner cable 27 inserted through an outer cable 26 which is engaged with and retained at one end thereof on a case 25 detachably connected to the cylinder body 12. One end of the inner cable 27 protruding from one end of the outer cable 26 is operatively connected to the connecting shaft portion 21*a* of the rotor 21 through a power-transmitting mechanism 28 accommodated in the case 25.

The case 25 comprises a first case half 29 fastened to the cylinder body 12, and a second case half 30 engaged with the first case half 29. The first case half 29 is fastened by a screw member 31 to an upper support plate portion 12*a* integrally provided at a rear end of the cylinder body 12 to extend upwards, and a pair of engagement claws 33 provided on the second case half 30 are resiliently engaged into a pair of engagement bores 32 provided in the first case half 29 on opposite sides of the cylinder lock 11, respectively. Moreover, when the first case half 29 has been fastened to the upper support plate portion 12*a*, the second case half 30 is sandwiched between the first case half 29 and the upper support plate portion 12*a*. A lower support plate portion 12*b* is integrally provided at the rear end of the cylinder body 12 to extend downwards, and a positioning tube 35 is provided integrally and projectingly on the second case half 30 to determine the position of the case 25 relative to the cylinder body 12 by fitting a bottomed cylindrical positioning pin 34 projectingly provided on the lower support plate portion 12*b* into the positioning tube 35.

An engagement tube member 36 is secured to one end of the outer cable 26, so that the one end of the outer cable 26 is positioned and retained on the case 25 by bringing engagement projections 38, 38 provided integrally on lower portions of the case halves 29 and 30 into engagement in an annular groove 37 provided in an outer periphery of the engagement tube member 36.

The inner cable 27 is mounted to extend through the engagement tube member 36 into the case 25, and the power-transmitting mechanism 28 is comprised of a first bevel gear 39 as a transmitting wheel relatively non-turnably connected to the rotor 21 in response to the mounting of the case 25 to the cylinder body 12, and a second bevel gear 40 which is meshed with the first bevel gear 39 and has an axis perpendicular to the first bevel gear 39, and to which one end of the inner cable 27 is secured coaxially.

The first bevel gear 39 is turnably carried between the first and second case halves 29 and 30 and has coaxially a connecting tube portion 39*a* facing into an opening 41 provided in the second case half 30, and the connecting shaft portion

21*a* of the rotor 21 is relatively non-turnably fitted into a fitting recess 42 provided coaxially in the connecting tube portion 39*a*. The second bevel gear 40 is also turnably carried between both of the case halves 29 and 30 in such a manner that it is maintained meshed with the first bevel gear 39.

With such arrangements of the case 25 and the power-transmitting mechanism 28, the first bevel gear 39 of the power-transmitting mechanism 28 is relatively non-turnably connected to the connecting shaft portion 21*a* of the rotor 21 carried on the cylinder body 12 by mounting the case 25 to the cylinder body 12 mounted to the door D. The power-transmitting mechanism 28 converts the turning movement of the first bevel gear 39 responsive to the turning of the rotor 21 of the cylinder lock 11 by the key operation into the twisting motion of the inner cable 27 of the turning movement-transmitting member 15. Moreover, the turning motion of the rotor 21 is transmitted to one end of the turning movement-transmitting member 15 through the power-transmitting mechanism 28 comprising the first and second bevel gears 39 and 40 having axes intersecting each other at right angles. Therefore, the turning movement-transmitting member 15 is operatively connected at one end to the rotor 21 to extend in a direction perpendicular to the axis of the rotor 21.

The twisting motion of the turning movement-transmitting member 15 is converted into the turning movement of a turn member 45 as an input member of the door-locking device 13, but if the turning movement-transmitting member 15 is longer, a loss of transmission of a turning force provided by the twisting of the turning movement-transmitting member 15 is larger. Therefore, the power-transmitting mechanism 28 is constructed to transmit the turning movement of the rotor 21 at a double angle to the inner cable 27 by the meshing of the first and second bevel gears 39 and 40 with each other. Thus, when it is required to turn the turn member 45, for example, through 30 degree in response to the switching of the unlocking state and the locking state of the door-locking device 13 from one to another, the turn member 45 can be turned reliably in a range of 30 degree or more by the transmission of the turning force provided by the twisting motion of the turning movement-transmitting member 15.

Referring again to FIG. 2, the casing 14 of the door-locking device 13 is provided with an admission groove 46 into which a striker (not shown) on a vehicle body can be admitted. Thus, the door D is locked in a closed state by inhibiting the turning of a latch 47 which is turnably carried on the casing 14 in such a manner that it is brought into engagement with the striker admitted in the admission groove 46 and rotated upon closing of the door D. The locked state of the door D is canceled by permitting the turning of the latch 47, whereby the door D is brought into the unlocked state. In this unlocked state, the door D can be opened.

Figure 4:
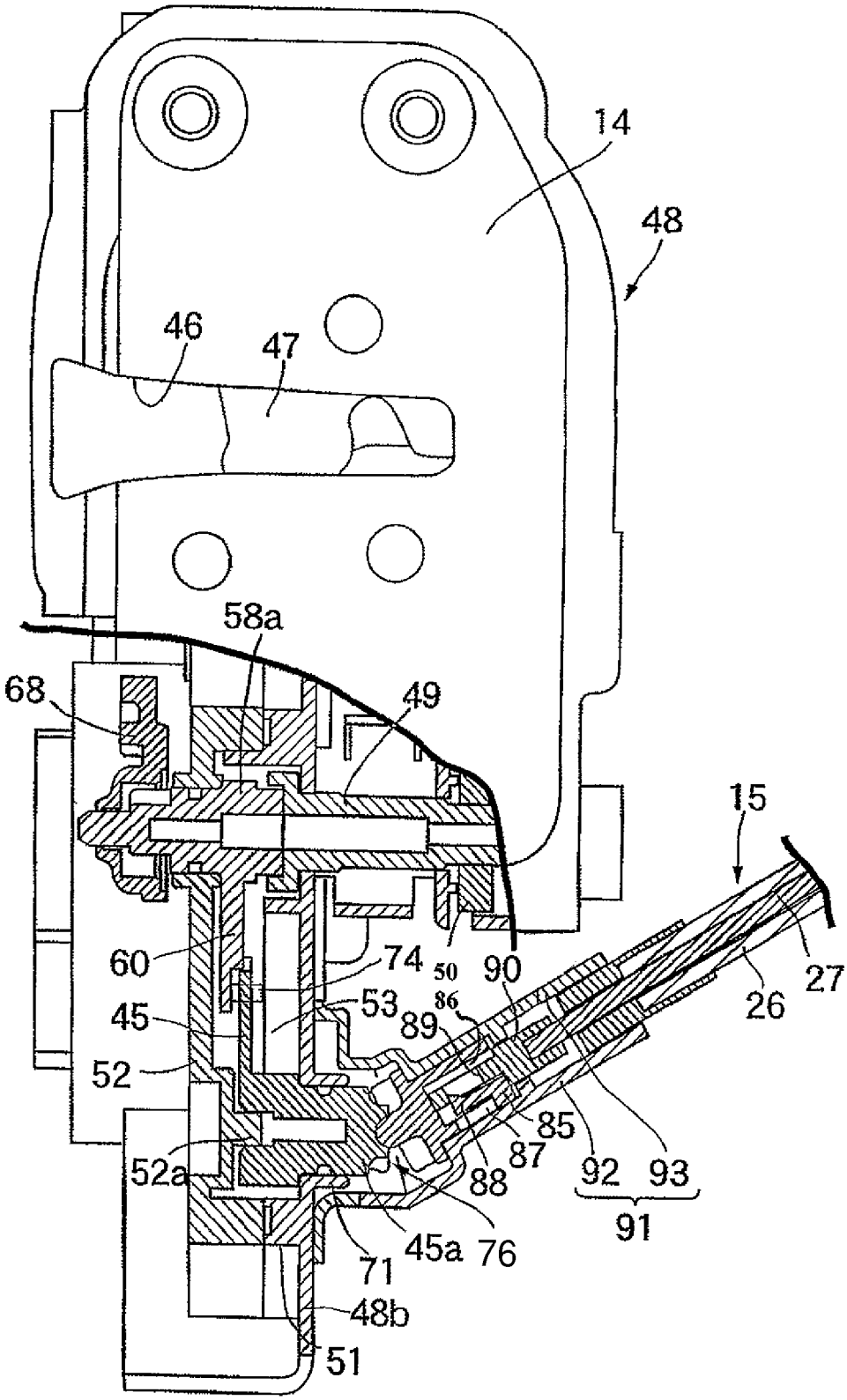

Referring also to FIG. 4, the casing 14 is covered with a cover 48 made of a synthetic resin. The cover 48 is formed into a substantially L-shape and integrally provided with a main cover portion 48*a* formed into a box-shape with a side closer to the casing 14 being opened, and a support wall 48*b* rising from the main cover portion 48*a*.

A door-locking lever shaft 49 having an axis parallel to a direction of extension of the admission groove 46 in the casing 14 is turnably carried on the support wall 48*b*, and a door-locking lever 50 is fixed to the door-locking lever shaft 49. The locking state and the unlocking state of the door-locking device 13 are switched over from one to another by the turning of the door-locking lever 50, i.e., the door-locking lever shaft 49 between a locking position and an unlocking position.

A protrusion 51 extending in an endless shape is integrally provided on the support wall 48*b* of the cover 48 on the side of a striker-admission port of the admission groove 46. A lid plate 52 made of a synthetic resin is mounted to the protrusion 51, and an operating chamber 53 is defined between the support wall 48*b* of the cover 48 and the lid plate 52, so that one end of the door-locking lever shaft 49 faces into the operating chamber 53.

The following components are accommodated in the operating chamber 53: an electric motor 54 having a rotational axis parallel to a plane perpendicular to an axis of the door-locking lever shaft 49; a worm 55 connected coaxially to an output shaft of the electric motor 54; a worm wheel 56 meshed with the worm 55 and having an axis parallel to the door-locking lever shaft 49; a pinion 57 connected coaxially to the worm wheel 56 for turning movement in a limited range relative to the worm wheel 56; a sector gear 58 connected coaxially for relative non-turning movement to the door-locking lever shaft 49 and meshed with the pinion 57; a slide plate 59 connected at one end to the sector gear 58; a key-operation input lever 45 having an axis parallel to the door-locking lever shaft 49; and an arm 60 integrally provided on the sector gear 58, so that it can be brought into engagement with the key-operation input lever 45.

The electric motor 54 is rotatable in normal and reverse directions and clamped between the support wall 48*b* of the cover 48 and the lid plate 52 in such a manner that it is partially accommodated in a recess 61 provided in the support wall 48*b* of the cover 48. The worm wheel 56 and the pinion 57 are turnably carried on a support shaft 62 supported between the support wall 48*b* and the lid plate 52.

A spring (not shown) is mounted between the worm wheel 56 and the support wall 48*b* and acts to return the worm wheel 56 to a position before being turned in the normal and reverse directions, when the electric motor 54 is at stoppage of operation.

One end of a shaft portion 58*a* integrally provided on the sector gear 58 is passed air-tightly and turnably through the lid plate 52 to protrude to the outside, and the other end of the shaft portion 58*a* is relatively non-turnably fitted into one end of the door-locking lever shaft 49. To determine the relative positions of the sector gear 58 and the pinion 57 regularly when the sector gear 58 and the pinion 57 are assembled, a positioning projection 63 is provided on the sector gear 58 to protrude toward the pinion 57, and a positioning recess 64 is provided in the pinion 57, so that the positioning projection 63 can be fitted into the positioning recess 64.

The slide plate 59 is formed of a synthetic resin to extend along a plane perpendicular to an axis of turning of the sector gear 58 and placed in sliding contact with the support wall 48*b*. Moreover, an elongated bore 65 is provided in the slide plate 59 to extend along a lengthwise direction of the slide plate 59, and a pin 66 embedded in the support wall 48*b* is inserted through the elongated bore 65, whereby the slide plate 59 is guided so that it is moved in the lengthwise direction.

A pair of movable contacts 67, 67 electrically connected to each other are fixed to the slide plate 59, so that the locking positions and the unlocking positions of the door-locking lever shaft 49 and the door-locking lever 50 are detected by switching over the electric connection and disconnection of the movable contacts 67 to and from a plurality of stationary contacts (not shown) fixed to the lid plate 52 by the sliding operation of the slide plate 59, i.e., the turning movements of the sector gear 58, the door-locking lever shaft 49 and the door-locking lever 50.

A knob lever 68 is fixed to one end of the shaft portion 58*a* integrally provided on the sector gear 58 outside the lid plate 52. The knob lever 68 is turned in response to the operation of a locking knob (not shown) mounted on an inner surface of the door D. Namely, the locking state and the unlocking state of the door-locking device 13 are switched over from one to another even by the operation of the locking knob.

The key-operation input lever 45 is formed into a fan-shape. A shaft portion 45*a* integrally provided on the key-operation input lever 45 at a location corresponding to an essential portion of the fan-shape is turnably supported at one end on a support shaft 52*a* integrally provided on the lid plate 52, and also turnably supported at the other end on a support tube portion 71 integrally provided on the support wall 48*b* to extend air-tightly through the support tube portion 71.

A pair of engagement projections 72 and 73 are integrally provided on the key-operation input lever 45 and spaced apart from each other in a circumferential direction of the key-operation input lever 45, and an engagement pin 74 capable of being brought into engagement with the engagement projections 72 and 73 is projectingly provided at a tip end of an arm 60 extending from the sector gear 58 toward the key-operation input lever 45.

Figure 5:
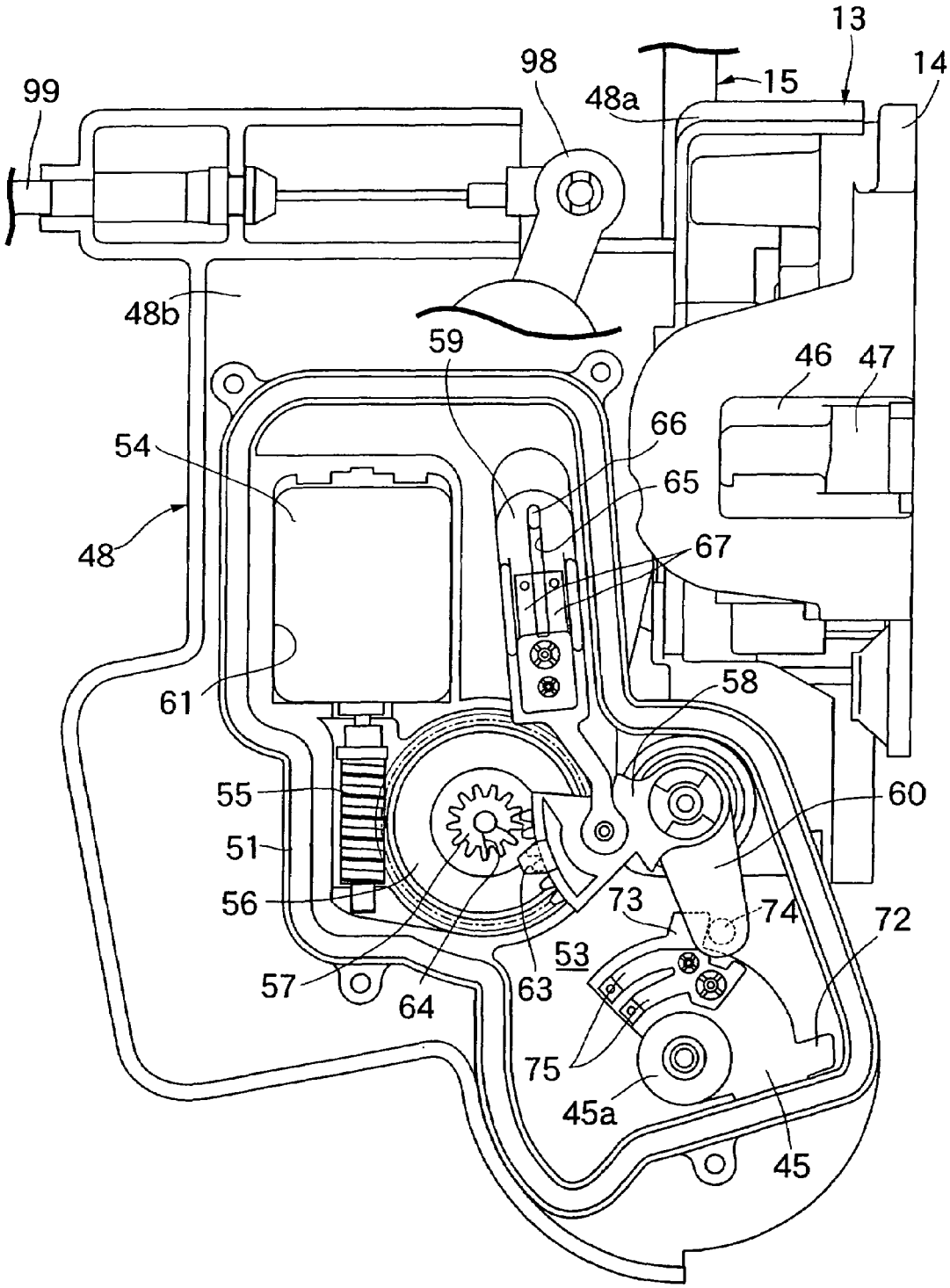

A turning force is input from the other end of the turning movement-transmitting member 15 to the key-operation input lever 45. When the cylinder lock 11 is operated by the key to the unlocking position, the key-operation input lever 45 is turned in a counterclockwise direction in FIG. 2, whereby one of the engagement projections 72 is brought into engagement with the engagement pin 74, thereby permitting the arm 60, i.e., the sector gear 58 and the door-locking lever shaft 49 to be turned in a clockwise direction in FIG. 2. The rotor 21 of the cylinder lock 11 is returned to the neutral position in response to the releasing of the operating force for bringing the cylinder lock 11 to the unlocking position, and the key-operation input lever 45 is also returned to the neutral position, as shown in FIG. 5. At this time, the arm 60 is left behind, and the door-locking lever shaft 49 remains in the unlocking position.

Figure 6:
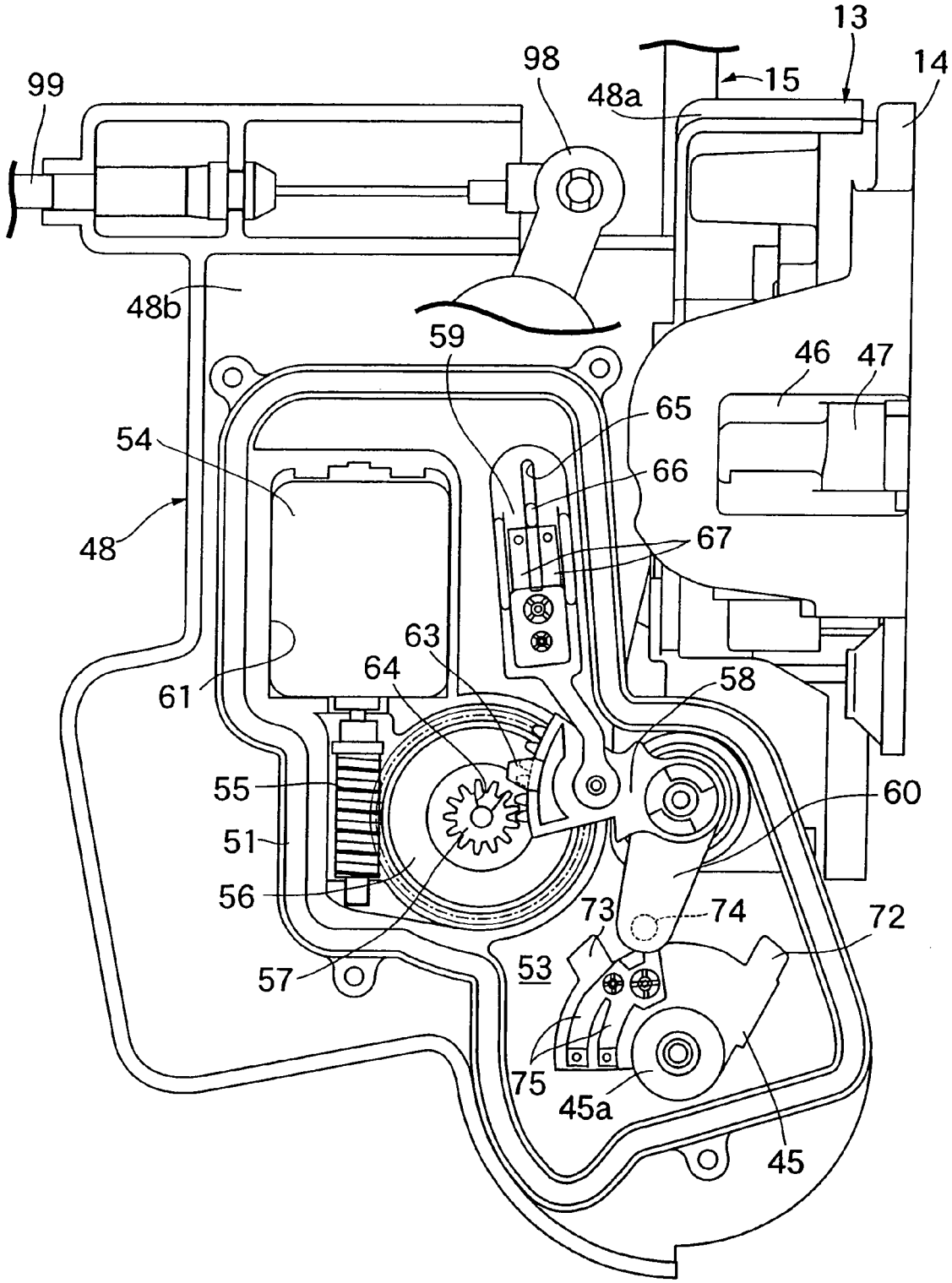

When the cylinder lock 11 is then operated by the key to the locking position, the key-operation input lever 45 is turned in a clockwise direction in FIG. 6 from the neutral position shown in FIG. 5, whereby the other engagement projection 73 is brought into engagement with the engagement pin 74, thereby permitting the arm 60, i.e., the sector gear 58 and the door-locking lever shaft 49 to be turned in a counterclockwise direction in FIG. 6. Even at this time, the rotor 21 of the cylinder lock 11 is returned to the neutral position in response to the releasing of the operating force for bringing the cylinder lock 11 to the locking position. The key-operation input lever 45 is also returned to the neutral position, as shown in FIG. 5, and the door-locking lever shaft 49 remains in the locking position.

When the locking state and the unlocking state of the door-locking device 13 are switched over from one to another by the operation of the electric motor 54 or by the operation of the locking knob, the key-operation input lever 45 cannot be turned by the arm 60, because it is in the neutral position shown in FIG. 5.

A pair of movable contacts 75, 75 electrically connected to each other are fixed to the key-operation input lever 45, and it is detected by the electrical connection and disconnection of the movable contacts 75 to and from the stationary contacts fixed to the lid plate 52 that the key-operation input lever 45 has been turned to the locking position and the unlocking position, i.e., that the locking and unlocking operations of the cylinder lock 11 have been carried out.

The turning movement-transmitting member 15 is connected at one end to the shaft portion 45*a* of the key-operation input lever 45 through a universal joint 76. The universal joint 76 is comprised of a first joint element 77 integrally formed at an end of the shaft portion 45 protruding from the support tube portion 71, and a second joint element 78 coupled to the other end of the inner cable 27 of the turning movement-transmitting member 15.

Figure 7:
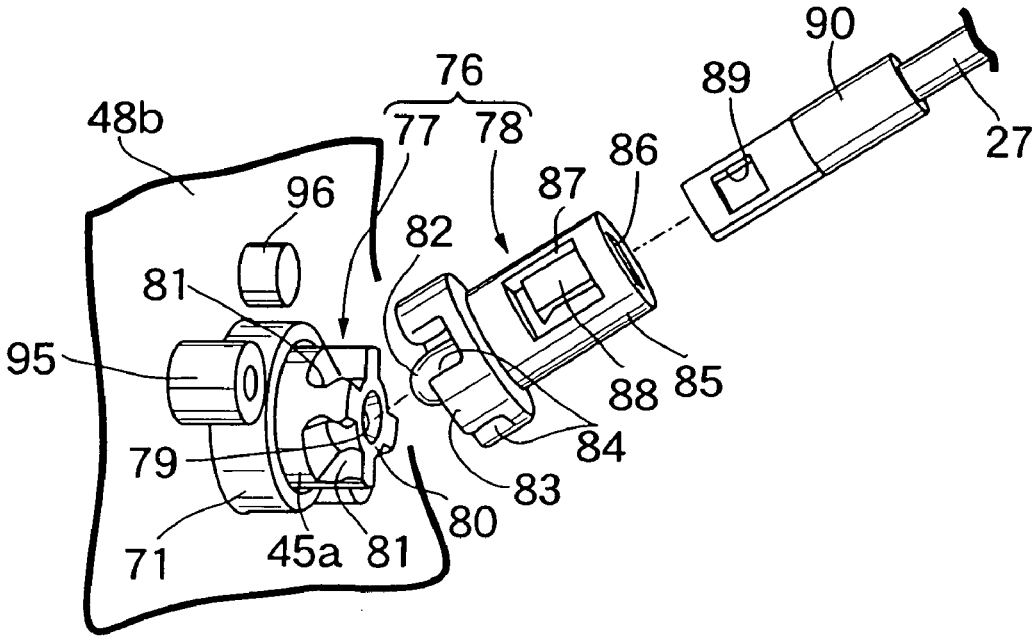
Figure 8:
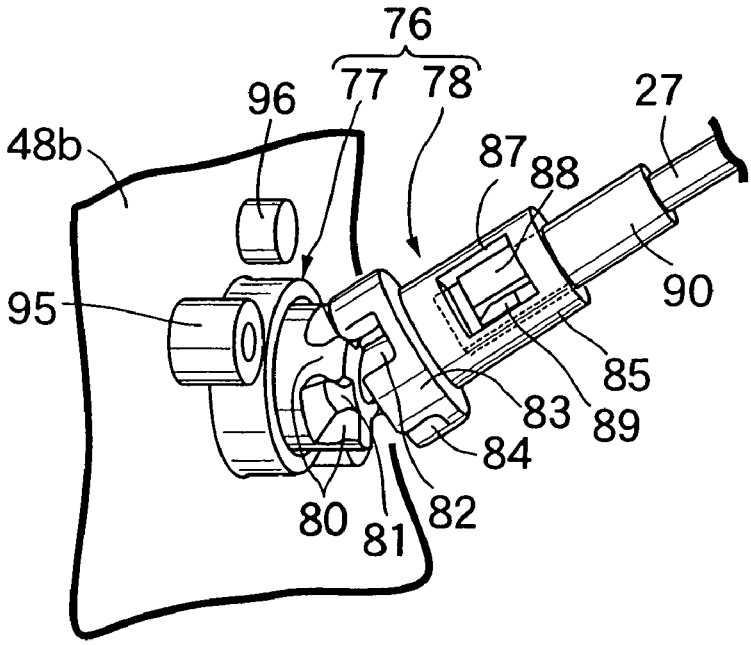

Referring also to FIGS. 7 and 8, the first joint element 77 comprises a first support shaft portion 80 disposed coaxially with the shaft portion 45*a* and having a semispherical fitting recess 79 at a tip end, and a plurality of, for example, four engagement arms 81 extending radially from the first support shaft portion 80. The second joint element 78 integrally includes a second support shaft portion 82 which is oscillatably fitted at its tip end into the fitting recess 79, an engagement tube portion 83 which surrounds the second support shaft portion 82 coaxially and has notches 84 at a plurality of, for example, four points equally spaced apart from one another in a circumferential direction, so that the engagement arm portions 81 are engaged into the notches 84, and a connecting tube portion 85 extending in a direction opposite from the first joint element 77 coaxially with the second support shaft portion 82 and the engagement tube portion 83.

The connecting tube portion 85 is provided with a bottomed insertion bore 86 rectangular in cross section, and also provided with an opening 87 into which an intermediate portion of the insertion bore 86 faces, and an engagement claw 88 disposed in the opening 87 in such a manner that its base end is connected to an end edge of the opening 87 closer to an open end of the insertion bore 86.

A connecting member 90 is secured to the other end of the inner cable 27 of the turning movement-transmitting member 15. The connecting member 90 is capable of being inserted into the insertion bore 86, and has an engagement bore 89 into which the engagement claw 88 can be resiliently engaged. Thus, the other end of the inner cable 27 is fixedly connected to the second joint element 78 through the connecting member 90 by inserting the connecting member 90 into the insertion bore 86 to bring the engagement projection 88 into resilient engagement in the engagement bore 89.

The universal joint 76 is accommodated in a retaining case 91 which is fastened to an outer surface of the support wall 48*b* of the cover 48, and an angle formed by the other end of the turning movement-transmitting member 15 (and thus, the axis of the second joint element 78) with respect to the axis of the key-operating input lever 45 (and thus, the axis of first joint element 77) is determined by the retaining case 91.

Figure 9:
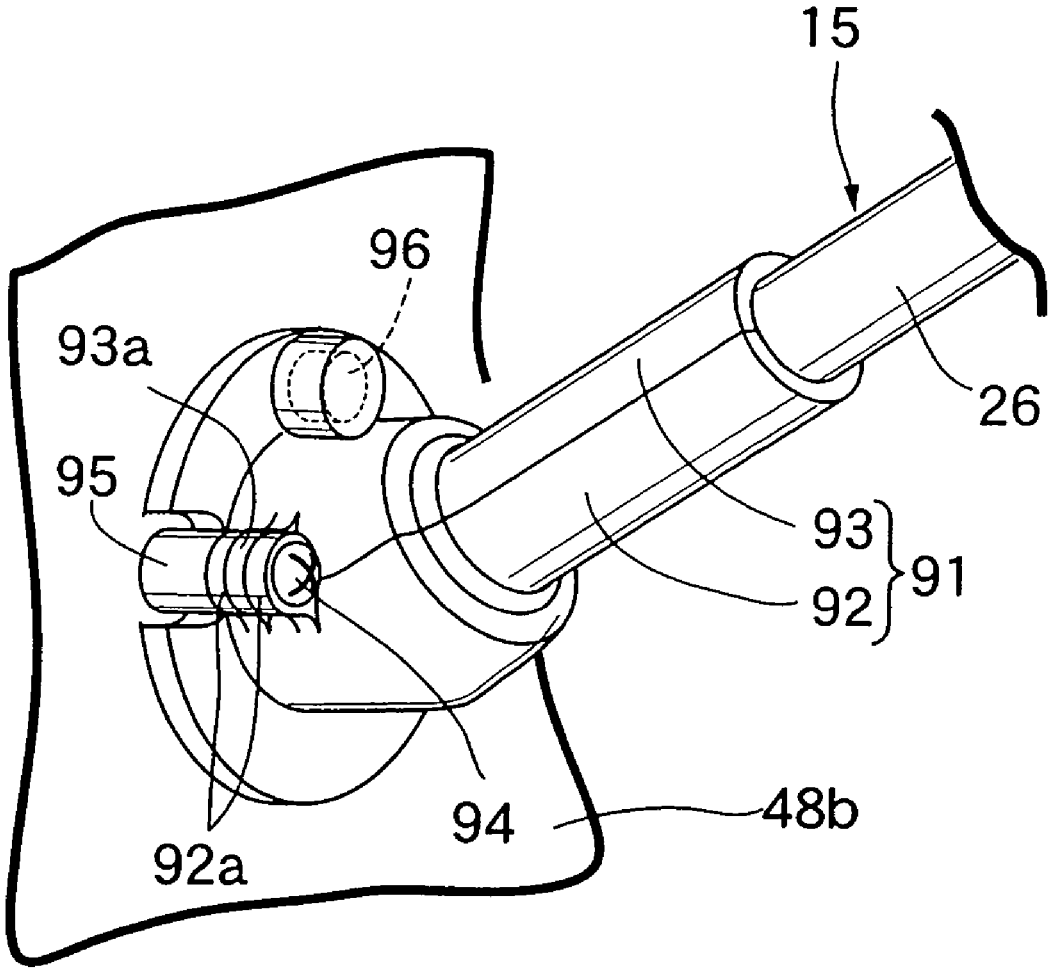

Referring to FIG. 9, the retaining case 91 comprises a pair of case halves 92 and 93. Fastening plate portions 92*a*, 92*a* are provided one by one at circumferentially opposite ends of one case half 92, and fastening plate portions 93*a* are provided one by one at circumferentially opposite ends of the other case half 93 and inserted between the fastening plate portions 92*a*, 92*a*. Thus, the retaining case 91 is fastened to the outer surface of the support wall 48*b* by allowing a screw member 94 inserted through the fastening plate portions 92*a*, 92*a*, 93*a*, 93*a* to be threadedly meshed with a boss 95 projectingly provided on the outer surface of the support wall 48*b*. Moreover, a positioning pin 96 is provided integrally and projectingly on the outer surface of the support wall 48*b* for determining a direction of inclination of the retaining case 91 with respect to the axis of the key-operating input lever 45 by fitting the positioning pin 96 into the retaining case 91.

The other end of the outer cable 26 of the turning movement-transmitting member 15 is inserted into a tip end of the retaining case 91.

In this manner, the other end of the turning movement-transmitting member 15 is operatively connected to the key-operation input lever 45 of the door-locking device 13, but the door-locking device 13 and the turning movement-transmitting member 15 are constructed in the form of a unit by fastening the retaining case 91 with the universal joint 76 accommodated therein to the support wall 48*b* of the cover 48 in the door-locking device 13.

An opening lever 97 is carried on the casing 14 of the door-locking device 13, so that it is turned in response to the inputting of a door-opening force. A lengthwise one end of the opening lever 97 protrudes from the casing 14, and an operating force corresponding to the operation of the outside handle 17 mounted on the outer surface of the door D is input to such one end. An input lever 98 is turnably carried on the cover 48 of the door-locking device 13 and turned by the pulling of the cable 99 responsive to the operation of an inside handle (not shown) mounted on the inner surface of the door D, and a power in a door-opening direction is transmitted from input lever 98 to the opening lever 97.

The operation of the embodiment will be described below. The turning movement-transmitting member 15 having the flexibility is disposed between the cylinder lock 11 and the door-locking device 13 in such a manner that the turning force of the rotor 21 is transmitted to the door-locking lever shaft 49 in the door-locking device 13 by the twisting motion responsive to the turning movement of the rotor 21 in the cylinder lock 11. Therefore, it is not necessary to dispose the axis of rotation of the rotor 21 and the axis of the door-locking lever shaft 49 on the same axis and thus, the degree of freedom for the relative disposition of the cylinder lock 11 and the door-locking device 13 can be increased.

Moreover, it is difficult to twist the turning movement-transmitting member 15 having the flexibility by the unauthorized access from the outside, and a protector covering the turning movement-transmitting member 15 is not required, which can be contribute to a reduction in number of parts.

The power-transmitting mechanism 28 including the first bevel gear 39 relatively non-turnably connected to the rotor 21 in response to the mounting of the case to the cylinder body 12 is accommodated in the case 25 detachably connected to the cylinder body 12 of the cylinder lock 11, and is connected to the one end of the turning movement-transmitting member 15 in such a manner that the turning movement of the first bevel gear 39 is converted into the twisting motion of the turning movement-transmitting member 15. In addition, the turning movement-transmitting member 15 is operatively connected at the other end thereof to the door-locking lever shaft 49 of the door-locking device 13 in such a manner that the door-locking device 13 and the turning movement-transmitting member 15 are constructed in the form of the unit. Therefore, one end of the rotor 21 of the cylinder lock 11 and one end of the turning movement-transmitting member 15 are operatively connected to each other by mounting the door-locking device 13 constructed as the unit along with the turning movement-transmitting member 15 to the door D and then mounting the case 25 to the cylinder body 12 of the cylinder lock 11 mounted to the door D. Therefore, the operation for connecting the cylinder lock 11 and the door-locking device 13 by the turning movement-transmitting member 15 is facilitated.

Further, since the turning movement-transmitting member 15 is operatively connected at one end to the rotor 21 of the cylinder lock 11 to extend in the direction perpendicular to the axis of the rotor 21, an area where the one end of the turning movement-transmitting member 15 is connected to the rotor 21 of the cylinder lock 11 cannot occupy a large space at the rear of the cylinder lock 11, and it is unnecessary to take into consideration the interference with a glass or the like accommodated in the door D.

Moreover, since the power-transmitting mechanism 28 mounted between the rotor 21 of the cylinder lock 11 and the one end of the turning movement-transmitting member 15 comprises the first and second bevel gears 39 and 40 meshed with each other, the loss of transmission of the turning force by the twisting of the turning movement-transmitting member 15 can be absorbed by adjusting the number of teeth of the bevel gears 39 and 40 to increase the transmission ratio.

Although the embodiment of the present invention has been described, it will be understood that the present invention is not limited to the above-described embodiments, and various modifications in design may be made without departing from the scope of the invention defined in claims.

For example, the turning movement-transmitting member 15 comprising the inner cable 27 inserted through the outer cable 26 is used in the above-described embodiment, but any other turning movement-transmitting member 15 may be used, if it transmits a turning force by a twisting motion responsive to the turning of the rotor 21 in the cylinder lock 11, and for example, a chain or the like may be used.

In addition, the power-transmitting mechanism 28 is comprised of the first and second bevel gears 39 and 40 meshed with each other in the above-described embodiment, but a power-transmitting mechanism 28 is not limited to one comprising the first and second bevel gears 39 and 40, if a turning movement-transmitting member can be extended in the direction perpendicular to the rotational axis of the rotor 21.

Further, the above-described embodiment is of the arrangement in which the turning force is transmitted from the turning movement-transmitting member 15 to the intermediate of the path for transmitting the power from the electric motor 54 to the locking lever shaft 49, but may be of an arrangement in which a turning force is transmitted from a turning movement-transmitting means directly to the door-locking lever shaft 49.

What is claimed is:

1. A door-opening and closing device in a vehicle, said device comprising:

a cylinder lock mounted to a door of the vehicle and including a rotor adapted to be turned in response to a key operation, said cylinder lock comprising a cylinder body;

a door-locking device mounted to an interior portion of the door of the vehicle, said door-locking device comprising a casing and a door-locking lever shaft which is configured to be turned in response to the turning of said rotor, said casing having a support wall with a support tube portion integrally formed thereon, wherein said door-locking device is configured to be switched over between a locking state and an unlocking state in response to the turning of said door-locking lever shaft; and a power-transmitting mechanism operatively interconnecting said cylinder lock and said door-locking device, said power-transmitting mechanism having a first end accommodated in a first retaining case detachably connected to said cylinder body, said power-transmitting mechanism including:

a transmitting wheel relatively non-turnably connected to said rotor in response to the mounting of said first retaining case to said cylinder body, and a flexible turning movement-transmitting member operatively connected at one end thereof to said transmitting wheel so as to perform a twisting motion responsive to the turning of said transmitting wheel, and operatively connected at the other end thereof to said door-locking lever shaft;

wherein said power-transmitting mechanism is configured to transmit the turning movement of said rotor to said turning movement-transmitting member via a double angle connection;

and wherein said turning movement-transmitting member and said door-locking device are connected to each other through a universal joint accommodated in a second retaining case, said second retaining case affixed on said support wall of said casing of said door-locking device such that said support tube portion of said support wall is substantially circumferentially enclosed, said universal joint comprising:

a first joint element partially protruding from and rotatably supported in said support tube portion, and a second joint element for fixedly receiving said turning movement-transmitting member at the other end thereof, said second joint element rotatably supported in said second retaining case, wherein said first joint element and said second joint element each have engaging portions fitted with each other such that said first joint element and said second joint element are concurrently rotatable when disposed non-coaxially with respect to one another.

2. A door-opening and closing device in a vehicle according to claim 1, wherein said turning movement-transmitting member is operatively connected at one end thereof to said rotor so as to extend in the direction perpendicular to an axis of said rotor.

3. A door-opening and closing device in a vehicle according to claim 2, wherein said power-transmitting mechanism comprises a first bevel gear as the transmitting wheel and a second bevel gear meshed with the first bevel gear and turnably carried between first and second case portions forming said first retaining case and connected to each other, and said turning movement-transmitting member is connected at one end thereof to said second bevel gear.

4. An assembly method of assembling a door-opening and closing device in a vehicle in which, in assembling the door-opening and closing device in the vehicle according to claim 1, said turning movement-transmitting member is connected at the other end thereof to said door-locking lever shaft and said door-locking device is mounted to the door, and then said first retaining case is mounted to said cylinder body of said cylinder lock mounted to the door.

5. A door-opening and closing device in a vehicle according to claim 1, wherein said second retaining case casing determines an angle formed by respective rotational axes of said first joint element and said second joint element.

6. A door-opening and closing device in a vehicle, said device comprising:

a cylinder body of a cylinder lock mounted to a door of the vehicle and including a rotor adapted to be turned in response to a key operation;

a casing of a door-locking device mounted to the door of the vehicle and including a door-locking lever shaft configured to be turned in response to the turning of said rotor, said casing having a support wall with a support tube portion integrally formed thereon, and wherein said door-locking device is configured to be switched over between a locking state and an unlocking state in response to the turning of said door-locking lever shaft;

a detecting device for detecting the locking state and the unlocking state of the door-locking device, said detecting device comprising a movable contact, wherein said casing is covered with a cover which defines, between the cover and the casing, an operating chamber for accommodating an electric motor which provides driving power for turning the door-locking lever shaft, wherein a key operation input member is accommodated in the operating chamber at a position below the electric motor as well as below the movable contact, said key operation input member configured so as to be turnable in the operating chamber between the casing and the cover, said key operation input member being operatively connected to said door-locking lever shaft; and wherein a flexible turning movement-transmitting member is provided between said cylinder lock and said door-locking device so as to perform twisting motion responsive to the turning of said rotor thereby to transmit a turning force of the rotor to the key operation input member.

7. A door-opening and closing device in a vehicle according to claim 6, wherein said turning movement-transmitting member is operatively connected at one end thereof to said rotor so as to extend in the direction perpendicular to an axis of said rotor.

8. A door-opening and closing device in a vehicle according to claim 7, further comprising a power-transmitting mechanism accommodated in a case detachably connected to said cylinder body mounted to the door, said power-transmitting mechanism including:

said turning movement-transmitting member, a transmitting wheel relatively non-turnably connected to said rotor in response to the mounting of said case to said cylinder body, a first bevel gear as the transmitting wheel and a second bevel gear meshed with the first bevel gear and turnably carried between first and second case portions forming said case and connected to each other, wherein said turning movement-transmitting member is fixed at one end thereof to said second bevel gear, and wherein said power-transmitting mechanism is configured to transmit the turning movement of said rotor to said turning movement-transmitting member at a double angle constituted by the meshed first and second bevel gears.

9. A door-opening and closing device in a vehicle according to claim 6, wherein said turning movement-transmitting member and said door-locking device are connected to each other through a universal joint, said universal joint comprising:

a first joint element partially protruding from and rotatably supported in said support tube portion; and a second joint element for detachably receiving said turning movement-transmitting member at the other end thereof, said second joint element rotatably supported in said casing;

wherein said first joint element and said second joint element each have engaging portions oscillatably fitted with each other such that said first joint element and said second joint element are concurrently rotatable when disposed non-coaxially with respect to one another.

* * * * *